US011355894B1

(12) United States Patent
Wu

(10) Patent No.: US 11,355,894 B1
(45) Date of Patent: Jun. 7, 2022

(54) TERMINAL CRIMPING MACHINE

(71) Applicants: DINKLE ENTERPRISE CO., LTD., New Taipei (TW); DINKLE ELECTRIC MACHINERY (CHINA) CO., LTD., Jiangsu (CN)

(72) Inventor: Shang-Tsai Wu, New Taipei (TW)

(73) Assignees: DINKLE ENTERPRISE CO., LTD., New Taipei (TW); DINKLE ELECTRIC MACHINERY (CHINA) CO., LTD., Jiangsu (CN)

( * ) Notice: Subject to any disclaimer, the term of this patent is extended or adjusted under 35 U.S.C. 154(b) by 0 days.

(21) Appl. No.: 17/206,934

(22) Filed: Mar. 19, 2021

(51) Int. Cl.
*H01R 43/055* (2006.01)
*H01R 43/048* (2006.01)

(52) U.S. Cl.
CPC ..... *H01R 43/055* (2013.01); *H01R 43/048* (2013.01); *Y10T 29/49181* (2015.01); *Y10T 29/53235* (2015.01)

(58) Field of Classification Search
CPC ..... H01R 43/048; H01R 43/055; Y10T 29/49181; Y10T 29/49185; Y10T 29/53235
See application file for complete search history.

(56) References Cited

U.S. PATENT DOCUMENTS 3,911,717 A * 10/1975 Yuda ..... H01R 43/055 29/863
4,064,624 A * 12/1977 Spangler ..... H01R 43/055 29/748
5,799,391 A * 9/1998 Tillotson ..... H01R 43/0488 29/863

* cited by examiner

*Primary Examiner* — Peter Dungba Vo
*Assistant Examiner* — Joshua D Anderson
(74) *Attorney, Agent, or Firm* — Chun-Ming Shih; HDLS IPR Services

(57) ABSTRACT

A terminal crimping machine includes a machine body and a cable diameter fitting mechanism. The machine body includes an installation portion, an adjustment member and a driven member. The driven member is driven by the adjustment member and includes a driven alignment portion. The cable diameter fitting mechanism includes an assembly portion corresponding to the driven alignment portion. The driven member is driven by the adjustment member to move with the adjustment of the adjustment member, and the driven alignment portion moves along with the driven member. The cable diameter fitting mechanism is installed on the installation portion, and the assembly portion is assembled corresponding to the driven alignment portion during the installation process. Accordingly, the terminal crimping machine can achieve the effect of simple and convenient operation.

15 Claims, 9 Drawing Sheets

TERMINAL CRIMPING MACHINE

BACKGROUND

Technical Field

The technical field relates to crimping of a terminal, and in particular, to a terminal crimping machine with fitting and adjustment functions.

Description of Related Art

A terminal crimping machine is mainly used for crimping terminal on the end portion of cables. Since cables have different cable diameters, terminals of corresponding calibers are required.

However, to satisfy the needs of cables of different cable diameters, most of the related-art terminal crimping machines require numerous disassembly operations, making the process tedious and inconvenient. Especially, the process requires to remove the first type of terminal chain connected in a bullet-chain like configuration from the jig first, followed by inserting the second type of terminal chain desired into the jig. Such tedious replacement operation of removal and insertion of terminal chains is necessary in related art to allow the terminal caliber to fit with the cable diameter of a cable. The process is inconvenient and is time and labor consuming. Accordingly, there is a need for improvement of such process.

SUMMARY OF PRESENT DISCLOSURE

An objective of the present disclosure is to provide a terminal crimping machine with fitting and adjustment functions.

To achieve the aforementioned objective, the present disclosure provides a terminal crimping machine used to crimp a terminal onto a cable. The terminal crimping machine includes: a machine body having an installation portion, an adjustment member and a driven member, the driven member configured to be driven by the adjustment member and having a driven alignment portion; and a cable diameter fitting mechanism configured to be insert by the cable with a selected cable diameter and having an assembly portion arranged corresponding to the driven alignment portion; wherein the driven member is driven by the adjustment member to move in a way of adjusting the adjustment member, and the driven alignment portion moves along with the driven member; the cable diameter fitting mechanism is installed on the machine body corresponding to the installation portion and the assembly portion is assembled corresponding to the driven alignment portion during an installation process.

In some embodiments, the terminal crimping machine further includes a terminal fitting mechanism, and the machine body further includes a driven body. The driven body is configured to be driven by the adjustment member and includes a plurality of linkage arms. The terminal fitting mechanism is configured to convey the terminal having a caliber corresponding to the selected cable diameter and includes a terminal channel. The driven body is driven by the adjustment member to move. The plurality of linkage arms is configured to move along with the driven body to drive the terminal fitting mechanism by at least one of the pluralities of linkage arms to correspondingly adjust a size of the terminal channel.

In comparison to related arts, the present disclosure is of the following technical effects. Only the corresponding cable diameter fitting mechanism may be installed onto the installation portion by rotating the adjustment member, and such cable diameter fitting mechanism only permits the insertion of cables of a selected cable diameter. Accordingly, the present disclosure achieves effect of simple and convenient operation. To be more specific, the present disclosure is able to further control that only terminals having corresponding calibers are permitted to enter into the terminal channel of the terminal fitting mechanism. Accordingly, it can achieve the time and labor-saving effect.

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
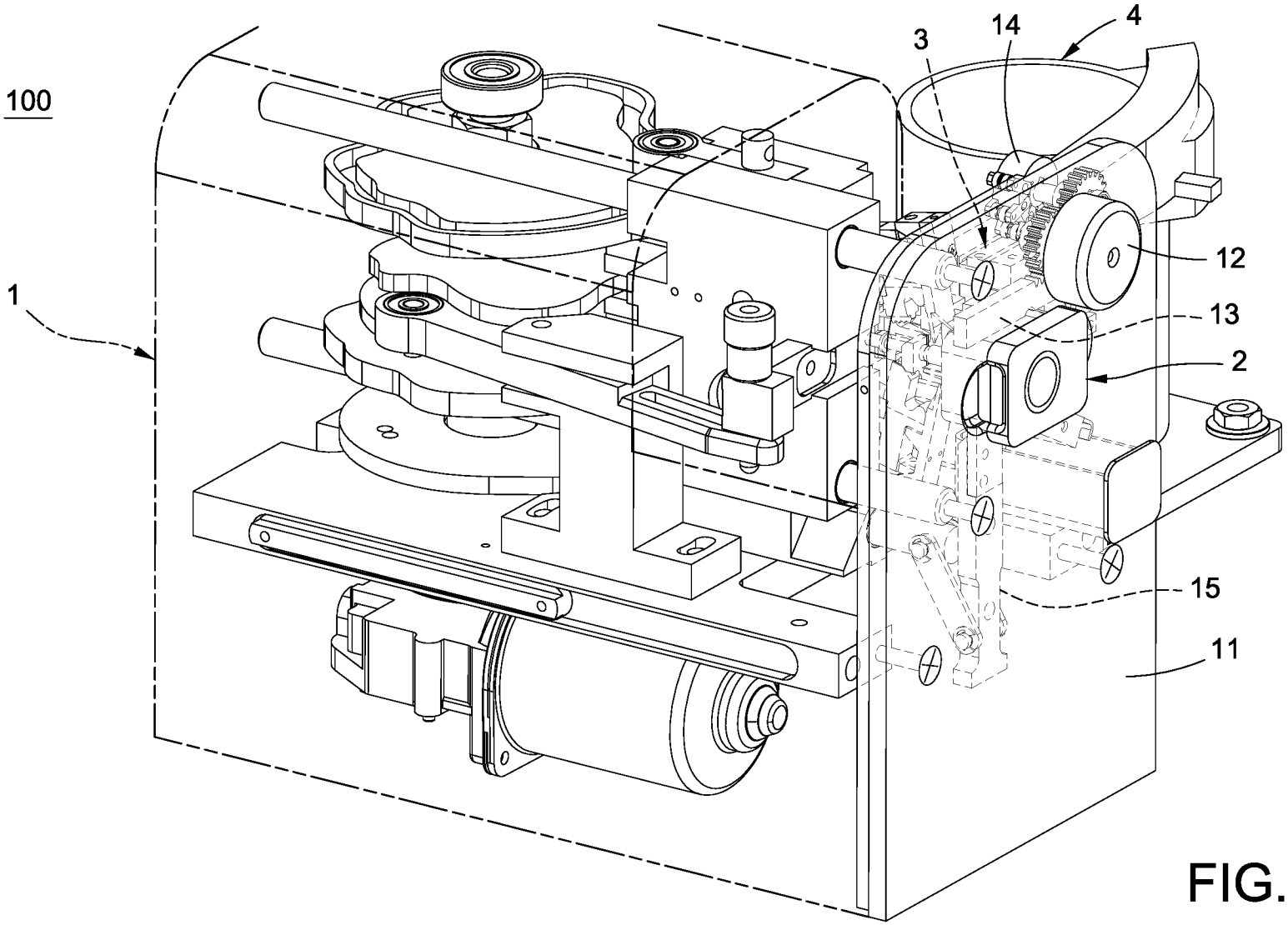
FIG. 1 is a perspective assembly view of the terminal crimping machine of the present disclosure viewed from a first viewing angle.

As shown in FIG. 1, the present disclosure provides a terminal crimping machine, used to crimp a terminal (not shown in the figures) onto a cable (not shown in the figures). The terminal crimping machine 100 of the present disclosure includes a machine body 1, a plurality of cable diameter fitting mechanism 2 and a terminal automatic feeding device 4. In some embodiments, the present disclosure further includes a terminal fitting mechanism 3.

As shown in FIG. 1 to FIG. 4 and FIG. 6, the machine body 1 includes a plurality of housings and a plurality of machine body parts. One of the housings 11 among the plurality of housings includes an installation portion 113. The installation portion 113 may be any structure capable of being used for the installation of the cable diameter fitting mechanism 2, and in an exemplary embodiment, a cavity is used as an example for illustration. One of the machine body parts 15 among the plurality of machine body parts is arranged inside the plurality of housings. In other embodiments not shown in the figures, the machine body part 15 may also be arranged outside the plurality of housings, and the present disclosure is not limited to any specific arrangement.

The housing 11 further includes an adjustment member 12 and a first driven member 13. In some embodiments, the housing 11 further includes a driven body 14. The present disclosure is not limited to any specific structural configuration of the adjustment member 12, the first driven member 13 and the driven body 14, as long as the first driven member 13 and the driven body 14 may be driven by the adjustment member 12 synchronously or asynchronously. The following provides detailed description of an exemplary embodiment of the present disclosure.

Figure 2:
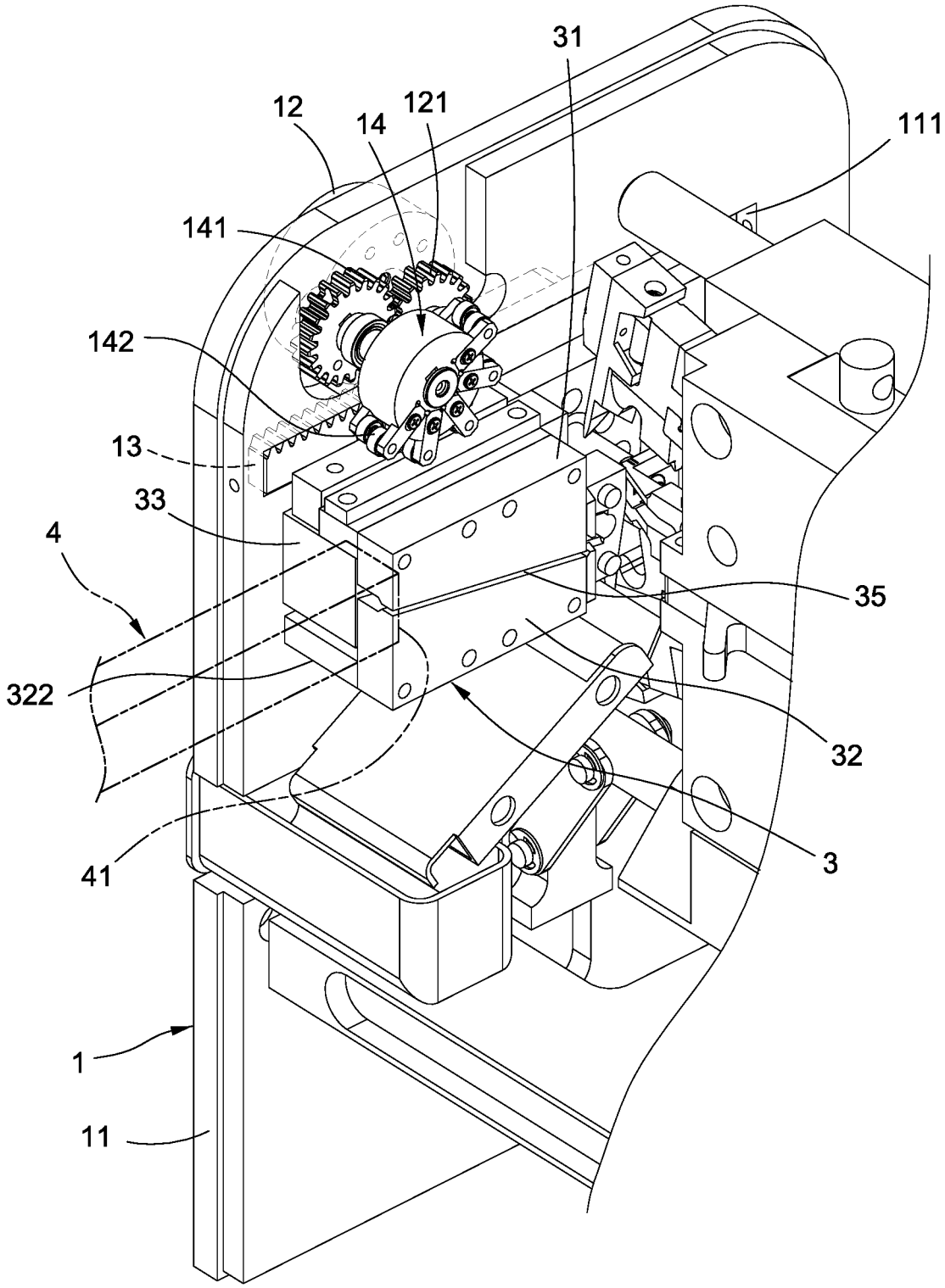
FIG. 2 is a perspective assembly view of the terminal crimping machine of the present disclosure viewed from a second viewing angle.
Figure 7:
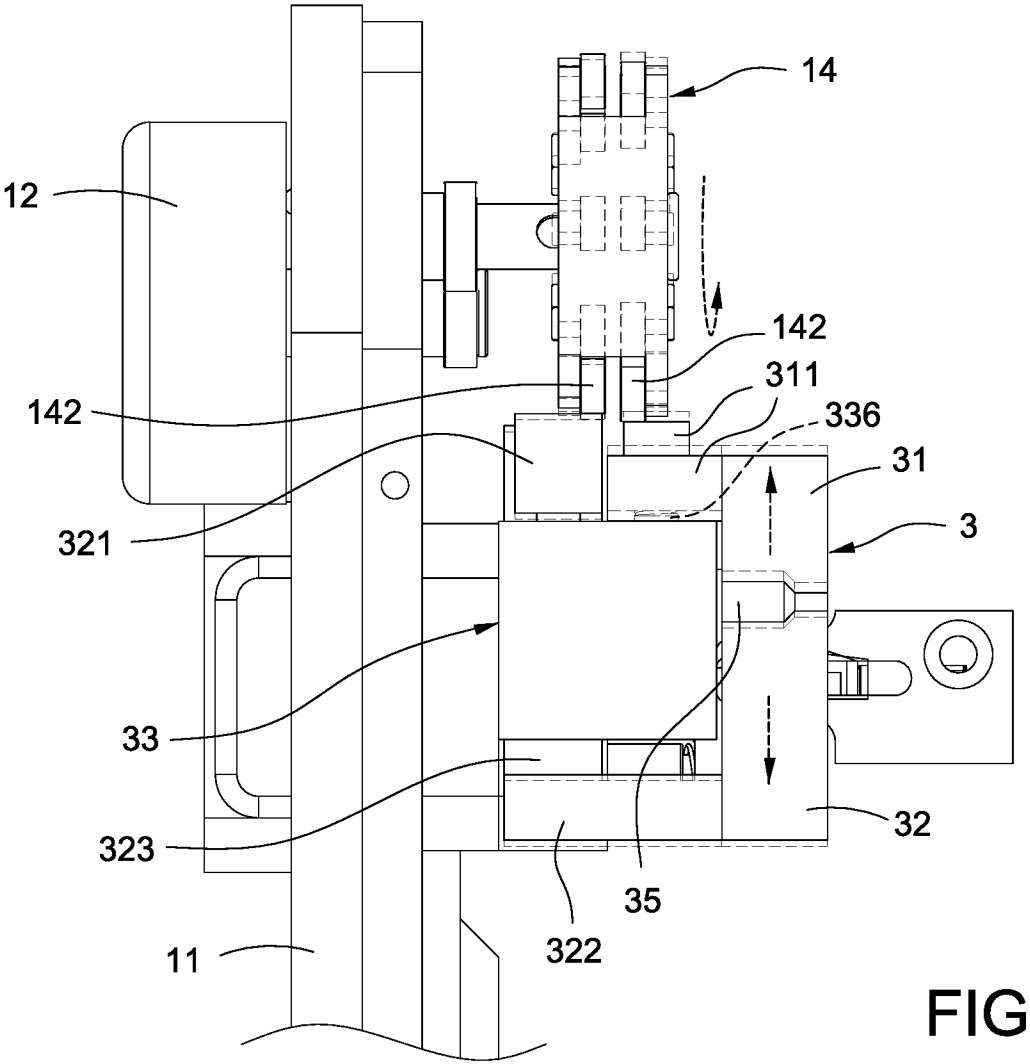
FIG. 7 is an adjustment schematic view of the terminal crimping machine of the present disclosure viewed from a second viewing angle.

The adjustment member 12 may be a knob and is rotatably arranged on the housing 11. The adjustment member 12 is further connected with a driving portion 121. The driving portion 121 may be a driving gear. The first driven member 12 may be a gear rack and is slidably attached to the housing 11. The first driven member 13 further includes a driven alignment portion 131, and the driven alignment portion 131 may be a notch. The driven body 14 may be a rotating wheel rotatably arranged on the housing 11. The driven body 14 is further connected with a second driven member 141, and the second driven member 141 may be a driven gear. The driving portion 121 (may be a driving gear as previously mentioned) engages with the first driven member 13 (may be a gear rack as previously mentioned) and the second driven member 141 (may be a driven gear as previously mentioned). Accordingly, when a user rotates the adjustment member 12, the adjustment member 12 can synchronously drive the first driven member 13 and the second driven member 141 to move by the driving portion 121, thereby the first driven member 13 brings the driven alignment portion 131 to move or horizontally move together relative to the housing 11, and the second driven member 141 brings the driven body 14 to rotate together relative to the housing 11. Furthermore, the driven body 14, as shown in FIG. 2 and FIG. 7, further includes a plurality of linkage arms 142 arranged in a fan shape corresponding to the two end surfaces (two circular corresponding ends of the rotating wheel). In other words, the driven body 14 can bring a plurality of linkage arms 142 to rotate together.

Figure 3:
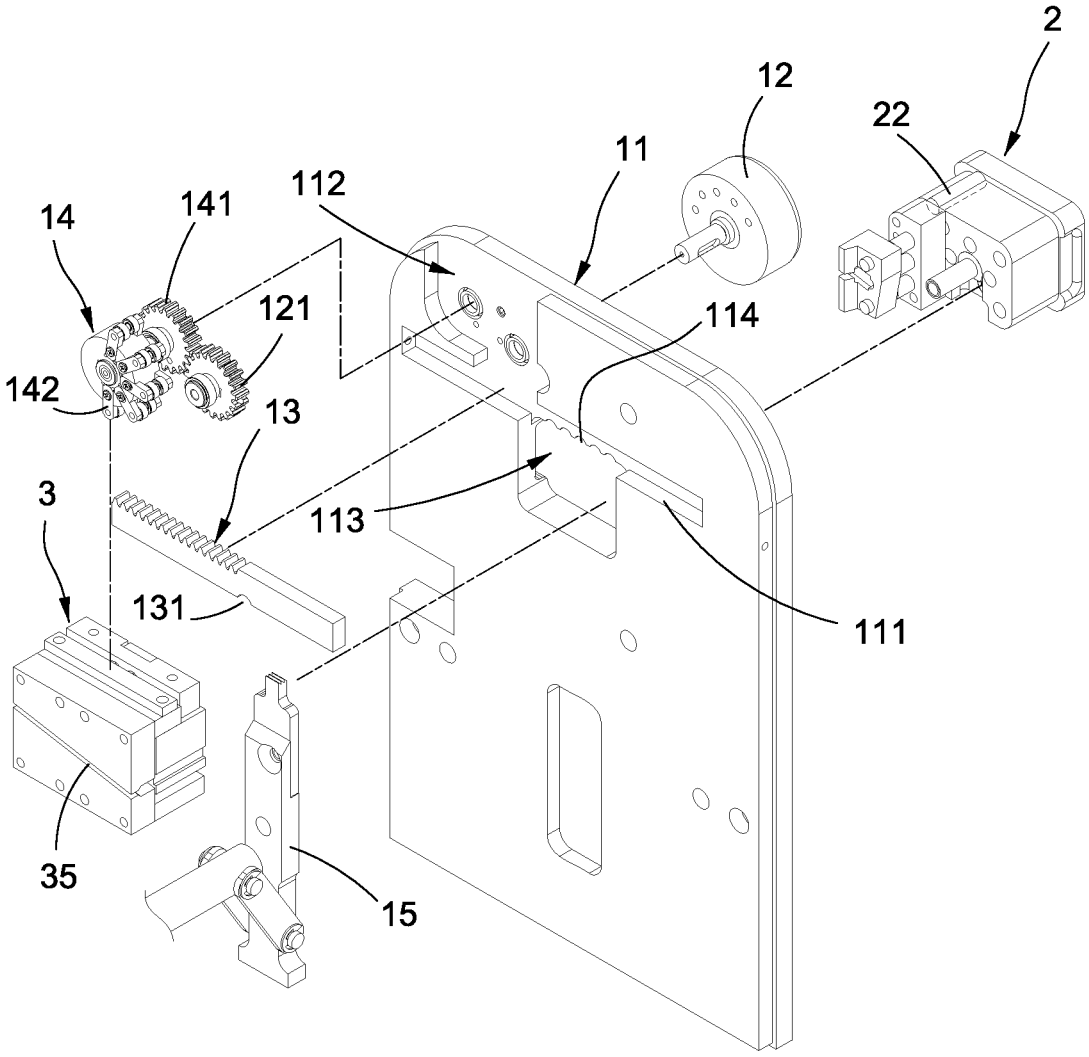
FIG. 3 is a perspective exploded view of the terminal crimping machine of the present disclosure viewed from a first viewing angle.

The present disclosure is not limited to any specific configuration of the first drive member 13, the second driven member 141 and the driving portion 121 on the housing 11. In exemplary embodiment (as shown in FIG. 3), the inner wall surface of the housing 11 is formed of a first sliding slot 111 and a concave slot 112 as an example for illustration. The first sliding slot 111 communicates between the concave slot 112 and the installation portion 113. The first driven member 13 is slidably accommodated or slidably attached inside the first sliding slot 111. The second driven member 141 and the driving portion 121 are arranged rotatably and parallel to each other inside the concave slot 112.

The housing 11 further includes a plurality of machine body alignment portions 114, and the machine body alignment portion 114 may be a notch (same as the driven alignment portion 131). As shown in FIG. 3, all of the machine body alignment portions 114 are arranged in linear along a moving direction or horizontal moving direction of the first driven member 13. In some other embodiments not shown in the drawings, the housing 11 of the present disclosure may also achieve the same purpose and effect without the machine body alignment portions 114. For example, the drive alignment portion 131 may be changed to a protruding key from a notch, and the assembly portion 22 arranged on the cable diameter fitting mechanism 2 may be changed from a protruding key to a notch (or a slot).

Figure 4:
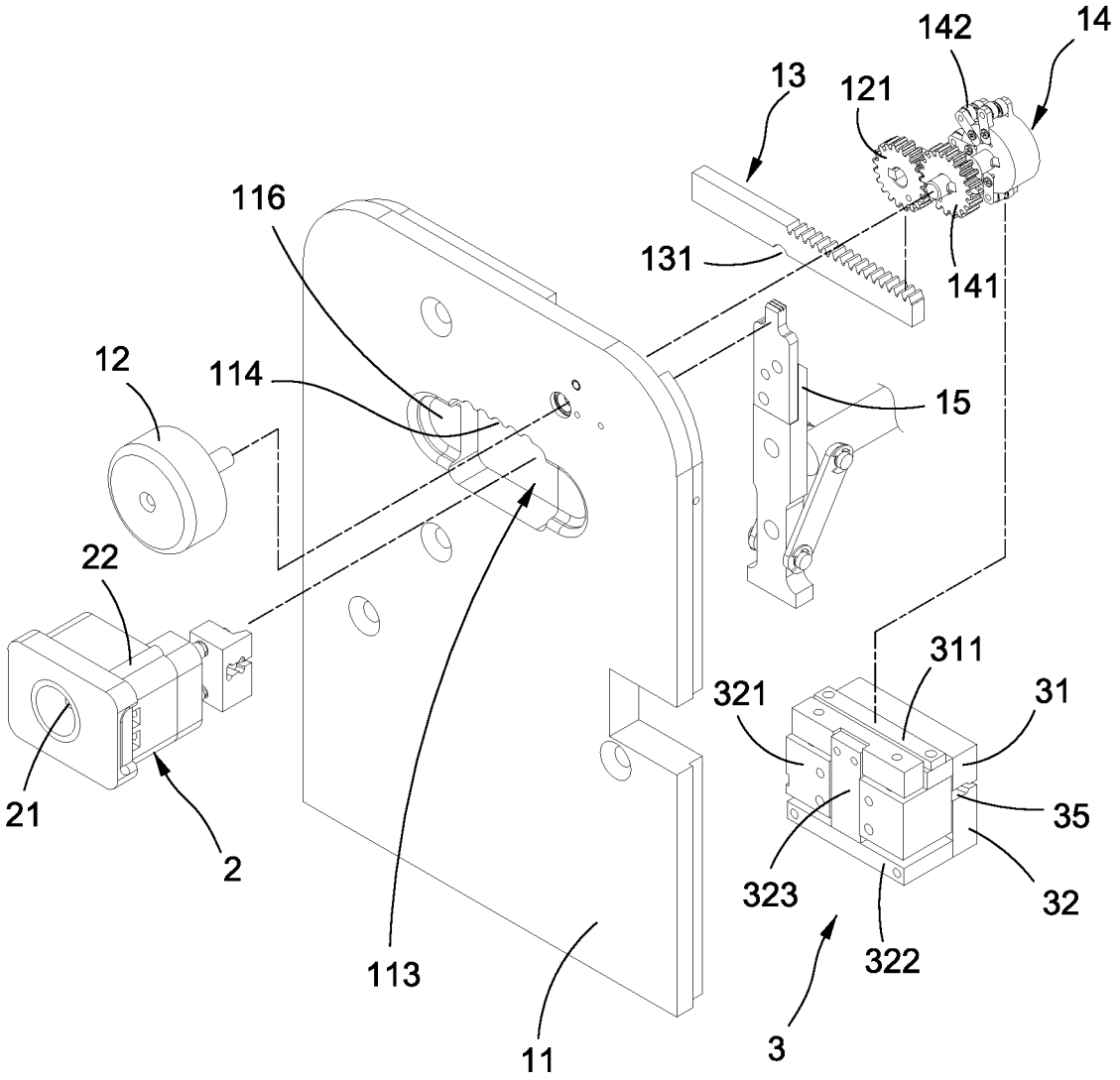
FIG. 4 is a perspective exploded view of the terminal crimping machine of the present disclosure viewed from a second viewing angle.
Figure 5:
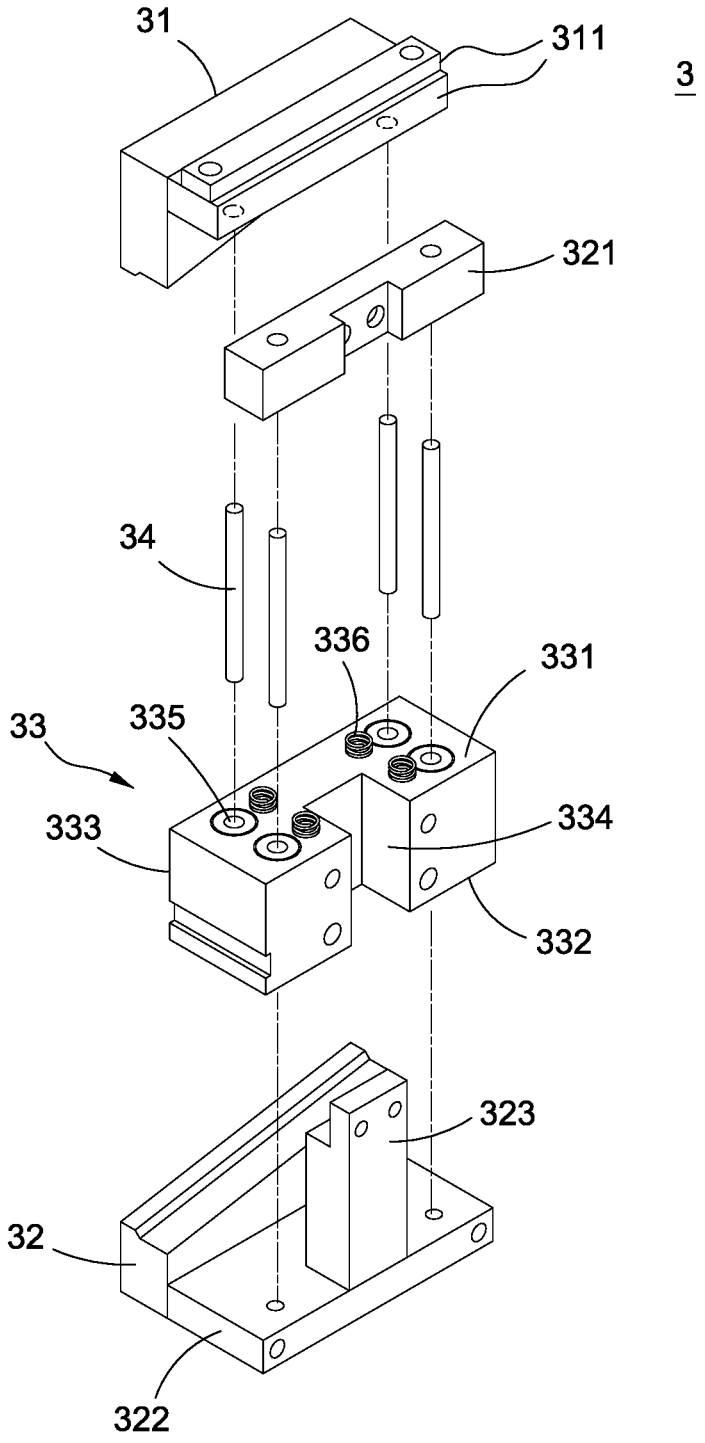
FIG. 5 is a perspective exploded view of the terminal fitting mechanism in the present disclosure.
Figure 6:
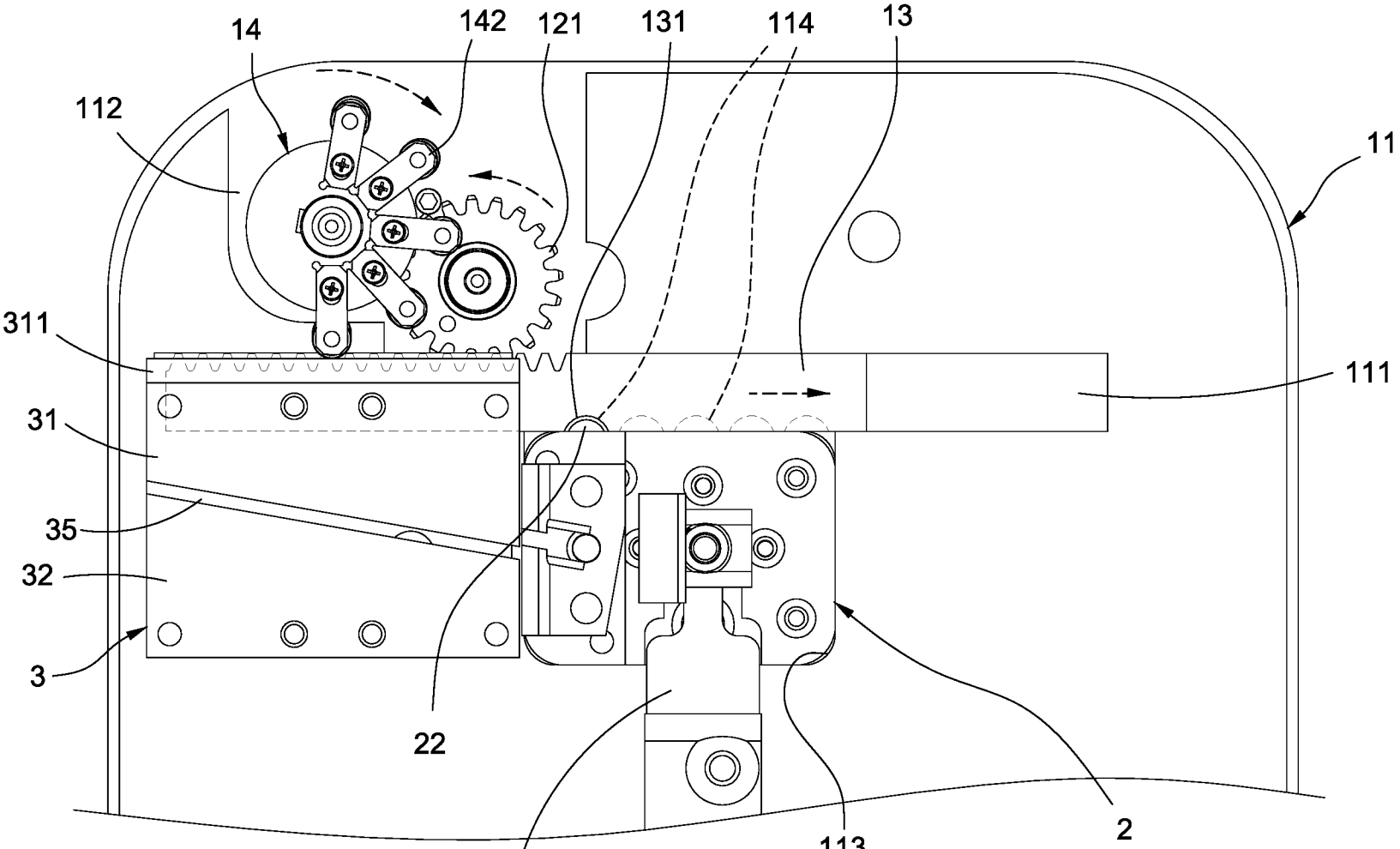
FIG. 6 is an adjustment schematic view of the terminal crimping machine of the present disclosure viewed from a first viewing angle.

The cable diameter fitting mechanism 2 may be a jig and may be correspondingly installed inside the installation portion 113. The cable diameter fitting mechanism 2 after installation may use, such as magnetic attachment or latch method, to be detachably secured onto the machine body 1. The cable diameter fitting mechanism 2 includes a cable insertion portion 21 (see FIG. 4) provided for cable insertion. Each cable diameter fitting mechanism 2 may be used for the insertion of a plurality of cables of different cable diameters respectively. Different locations on each cable diameter fitting mechanism 2 include an assembly member 22 respectively arranged corresponding to each machine body alignment portion 114. In an exemplary embodiment, as shown in FIG. 4, the assembly portion 22 is arranged on the outmost side (such as the rightmost side) of the top side of the first cable diameter fitting mechanism 2 in order to correspond with the machine body alignment portion 114 on the outmost side (such as the rightmost side) of the installation portion 113. The arrangement locations of the assembly portions 22 of the other cable diameter fitting mechanism 2 may be corresponding to the other machine body alignment portions 114 respectively. In addition, the assembly portion 22 may be a protruding key to be inserted correspondingly into the drive alignment portion 131 and one of the machine body alignment portions 114 as shown in FIG. 6. The drive alignment portion 131 and the machine body alignment portions 114 communicate with each other. It shall be noted that if the user uses an assembly portion 22 with the arrangement location not corresponding to the other cable diameter fitting mechanism 2 for installation onto the installation portion 113, such assembly portion 22 is blocked by the first driven member 13 and unable to be installed. Accordingly, such design achieves the foolproof effect.

In view of the above, the user rotates the adjustment member 12 on the external of the machine body 1 to control the first driven member 13 to move horizontally to a desired location, thereby the driven alignment portion 131 only communicates with the selected machine body alignment portion 114. At this time, among all of the cable diameter fitting mechanisms 2, only one cable diameter fitting mechanism 2 may be inserted into the corresponding driven alignment portion 131 and the selected machine body alignment portion 114 communicated to each other, and this is mainly due to the reason that only the arrangement location of the assembly portion 22 on this cable diameter fitting mechanism 2 corresponds to the driven alignment portion 131 being moved horizontally. Consequently, when the user uses such cable diameter fitting mechanism to install the corresponding installation portion 113, the assembly portion 22 may be correspondingly inserted into the driven alignment portion 131 and the machine body alignment portion 114 communicated to each other during the installation process. In addition, the user simply rotates the adjustment member 12 on the external of the machine body to select certain cable diameter fitting mechanism 2 desired for installation. In other words, the user is able to select the cable diameter of the cable desired for fitting onto the terminal. Accordingly, the present disclosure achieves the effect of cable diameter fitting and adjustment.

The terminal fitting mechanism 3, as shown in FIG. 2, is mainly used to convey the terminal having a caliber corresponding to the selected cable diameter. The terminal fitting mechanism 3 includes a terminal channel 35, and the terminal channel 35 may be adjusted to control the size of the channel. Accordingly, when the driven body 14 is driven to rotate, the terminal fitting mechanism 3 is driven or pushed according to different rotational angles of the driven body 14, thereby the terminal fitting mechanism 3 generates the terminal channel 35 with corresponding size.

As shown in FIG. 1 and FIG. 2, the terminal automatic feeding device 4 is used to automatically feed terminals to the terminal fitting mechanism 3. The present disclosure is not limited to how the terminal automatic feeding device 4 feeds materials automatically. In an exemplary embodiment, the automatic feeding device 4 includes a feed opening 41 (see FIG. 2), and the feed opening 41 communicates with the terminal channel 35 correspondingly.

As shown in FIG. 2 to FIG. 7, the terminal fitting mechanism 3 includes a first sliding block 31 and a second sliding block 32. In some embodiments, the terminal fitting mechanism 3 may further include a fixation base 33. The terminal channel 35 is formed between the first sliding block 31 and the second sliding block 32. The terminal fitting mechanism 3 may adjust the terminal channel 35 to a desired size by only a slide relative to the machine body 1 via the first sliding block 31. In an exemplary embodiment, the terminal fitting mechanism 3 uses both the first sliding block 31 and the second sliding block 32 to slide relative to the machine body 1 to adjust the terminal channel 35 to a desired size.

The fixation base 33 includes a top surface 331, a bottom surface 332 and a plurality of side surfaces. The side surfaces surround and connect between the perimeter of the top surface 331 and the perimeter of the bottom surface 332. The present disclosure is not limited to the fixation method of the fixation base 33. In an exemplary embodiment, one of the side surfaces (not indicated with a reference numeral, and referred to as the fixation side surface) of the fixation base 33 is secured onto the inner wall surface of the outer housing 11, and one of the side surfaces 333 is arranged opposite to the fixation side surface. The first sliding block 31 and the second sliding block 32 are slidably attached to the fixation base 33. Furthermore, the two sliding blocks 31, 32 with slidable attachment are arranged parallel to each other on the side surface 333 or located in front of the side surface 333.

To be more specific, the first sliding block 31 includes or is connected with a first linkage portion 311, and the second sliding block 32 includes or is indirectly connected with a second linkage portion 321. In addition, the first linkage portion 311 and the second linkage portion 321 are arranged parallel on the top surface 331. Furthermore, each one of the linkage arms 142 connected to one end surface of the driven body 14 is arranged corresponding to the first linkage portion 311 respectively, and each one of the linkage arms 142 connected to another end surface of the driven body 14 is arranged corresponding to the second linkage portion 321 respectively. The top surface 331 of the fixation base 33 includes a plurality of elastic elements 336, and the elastic elements 336 are elastically supported between the two linkage portions 311, 321 and the top surface 331 for facilitating the elastic restoration of the two linkage portions 311, 321.

The present disclosure is not limited to the indirect connection method adopted between the second sliding block 32 and the second linkage portion 321. In an exemplary embodiment, the following description is provided as an example to illustration the present disclosure. The second sliding block 32 is connected with an extension portion 322, and a straddling portion 323 is connected between the extension portion 322 and the second linkage portion 321 such that the extension portion 322 is located underneath the bottom surface 332.

The present disclosure is not limited to the sliding attachment method adopted between the two sliding blocks 31, 32 and the fixation base 33. In an exemplary embodiment, the following description is provided as an example to illustration the present disclosure. The top surface 331 of the fixation base includes a plurality of insertion holes 335, and the first linkage portion 311 and the second linkage portion 321 are respectively connected with at least two insertion rods 34. The insertion rods 34 are configured to be slidably inserted (i.e., slidable insertion) into each one of the insertion holes 335 correspondingly. In addition, each one of the insertion rods 34 connected to the second linkage portion 321 is further connected to the extension portion 322. In other words, the two ends of each insertion rod 34 are respectively connected to the second linkage portion 321 and the extension portion 322. Accordingly, both the first sliding block 31 and the second sliding block 32 may use the insertion rods 34 for inserting into the insertion holes 335 to achieve the required slidable attachment.

The present disclosure is not limited to any type of method for the straddling portion 323 to be connected between the extension portion 322 and the second linkage portion 321, as long as the two opposite ends of the straddling portion 323 are capable of penetrating through the top surface 331 and the bottom surface 332. In an exemplary embodiment, the fixation side surface of the fixation base 33 includes a second sliding slot 334, and the straddling portion 323 is inserted into the second sliding slot 334 to be slidably attached to the fixation base 33.

The terminal channel 35 is formed between the bottom edge of the first sliding block 31 and the top edge of the second sliding block 32 arranged oppositely and spacedly apart from each other.

Accordingly, the user rotates the adjustment member 12 on the external of the machine body 1 to drive the driven body 14 to rotate a desired angle via the second driven member 141, thereby the linkage arm 142 set at such angle drives or push the first linkage portion 311 independently, or at least two linkage arms 142 set at such angle drive or push the first linkage portion and the second linkage portion 321 respectively. Consequently, at least one of the two sliding blocks 31, 32 can slide relative to the fixation base (slide along the side surface 333 or parallel to the side surface 333) such that the size of the terminal channel 35 may be adjusted to fit with the cable diameter of the cable, and the terminal with corresponding caliber is permitted to pass through. As a result, the present disclosure achieves the terminal caliber fitting and adjustment effect.

The driving portion 121 in the present disclosure can drive the first driven member 13 and the second driven member 141 synchronously. In some other embodiments not shown in the drawings, the driving portion 121 may also be configured into two portions or may be controlled via clutch mechanism to selectively drive the (non-simultaneous, asynchronous) the first driven member 13 and the second driven member 141 respectively.

Figure 8:
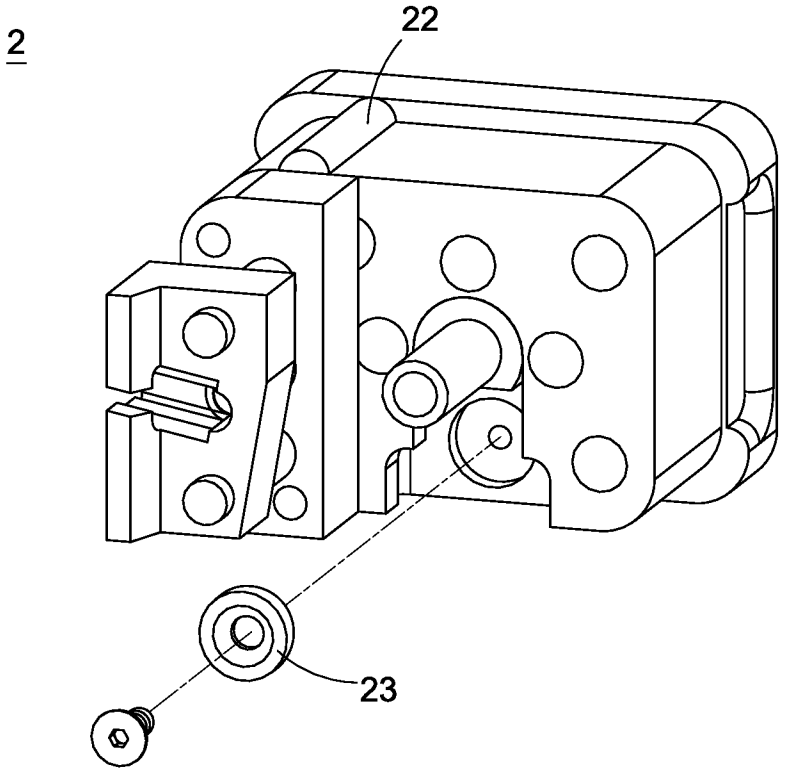
FIG. 8 is a perspective view according to a first exemplary embodiment of the cable diameter fitting mechanism in the present disclosure.
Figure 9:
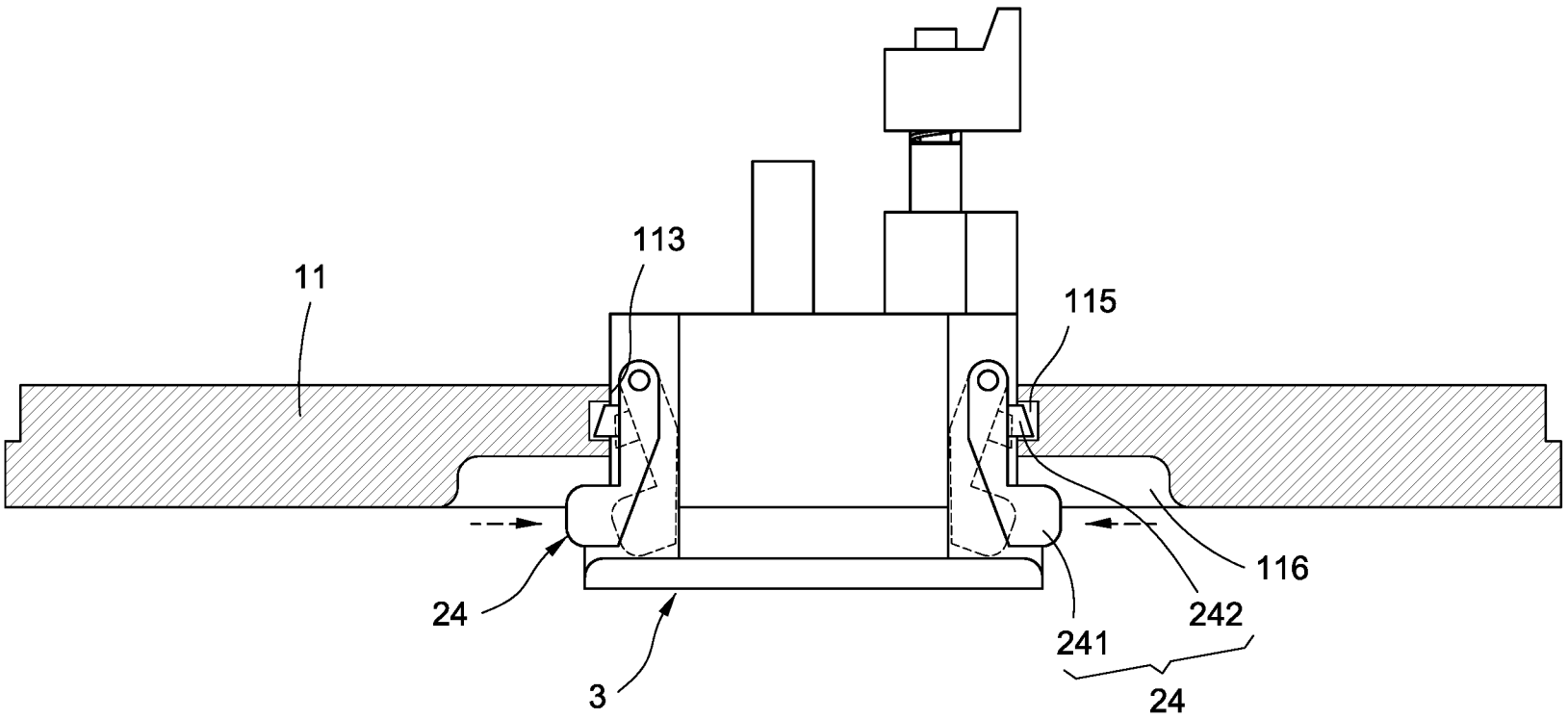
FIG. 9 is a perspective view according to a second exemplary embodiment of the cable diameter fitting mechanism in the present disclosure.

The present disclosure is not limited to any type of method to detachably secure the cable diameter fitting mechanism 2 onto the outer housing 11. Examples are described in the following: as shown in FIG. 8, the cable diameter fitting mechanism 2 may include a magnetic member 23. Accordingly, when the user installs the cable diameter fitting mechanism 3 onto the installation portion 113, the magnetic member 23 is magnetically attached onto the machine body part 15 arranged on the corresponding position for fixation. As shown in FIG. 9, the two opposite sides of the cable diameter fitting mechanism 2 may be arranged with two hooks 24, and each hook may include a pressing portion 241 and a latch portion 242, and the housing 11 may include two retaining slots 115 corresponding to the two latch portions 242. Accordingly, under normal condition, each latch portion 242 is retained and locked inside each corresponding retaining slot 115. When the user uses two fingers to press each pressing portion 241, each latch portion 242 is driven to be released to disengage from each retaining slot 115. Moreover, the outer wall surface of the housing 11 includes two concave portions 116 indented inward thereon for the user to insert two fingers therein and to facilitate the pressing of the two pressing portions 241.

In view of the above, the terminal crimping machine of the present disclosure can achieve the expected purpose of use and to overcome the deficiency of current related arts, such that it complies with the patentability and an application is hereby submitted for the protection of the rights of the inventor.

The above is only the feasible embodiments of this disclosure, and not intended to limit the protection scope of this disclosure. Equivalent changes and structural modifications based on the description and drawings of this disclosure should be deemed to be within the protection scope of this disclosure.

What is claimed is:

1. A terminal crimping machine, used to crimp a terminal onto a cable, the terminal crimping machine comprising:

a machine body comprising an installation portion, an adjustment member, and a driven member, the driven member configured to be driven by the adjustment member and comprising a driven alignment portion comprising one of a notch and a protruding key; and a cable diameter fitting mechanism configured to permit the insertion of the cable with a selected cable diameter and comprising an assembly portion arranged corresponding to the driven alignment portion and comprising a protruding key corresponding to a notch of the driven alignment portion or a notch corresponding to a protruding key of the driven alignment portion;

wherein the driven member is driven by the adjustment member to move relative to the machine body and the driven alignment portion moves along with the driven member thereby adjusting the position of the driven alignment portion with respect to the installation portion to allow the cable diameter fitting mechanism to be installed on the machine body inside the installation portion such that the assembly portion is assembled corresponding to the driven alignment portion.

2. The terminal crimping machine according to claim 1, wherein the cable diameter fitting mechanism comprises a magnetic member configured to magnetically attach on the machine body after the cable diameter fitting mechanism is installed.

3. The terminal crimping machine according to claim 1, wherein the cable diameter fitting mechanism comprises two hooks, and each one of the hooks comprises a pressing portion and a latch portion, the machine body comprises two retaining slots corresponding to the two latch portions, each one of the latch portions is retained and locked inside each one of the retaining slots correspondingly, each one of the latch portion is released to disengage from each one of the retaining slots via pressing each one of the pressing portions.

4. The terminal crimping machine according to claim 1, wherein the driven member comprises a gear rack, and the adjustment member comprises at least one gear engaged with and driving the driven member to move relative to the machine body.

5. The terminal crimping machine according to claim 1, wherein the machine body further comprises a plurality of machine body alignment portions, the assembly portion is configured to be assembled onto the driven alignment portion and one of the machine body alignment portions correspondingly.

6. The terminal crimping machine according to claim 5, wherein the assembly portion comprises a protruding key configured to protrude from the cable diameter fitting mechanism, the driven alignment portion and each one of the machine body alignment portions are configured to be a notch corresponding to the protruding key, the driven alignment portion and one of the machine body alignment portions are jointly configured to be a slot corresponding to the protruding key.

7. The terminal crimping machine according to claim 1, further comprising a terminal fitting mechanism, and the machine body further comprising a driven body configured to be driven by the adjustment member, the driven body comprising a plurality of linkage arms, the terminal fitting mechanism configured to convey the terminal with a caliber corresponding to the selected cable diameter and comprising a terminal channel; wherein, the driven body is driven by the adjustment member to move, the plurality of linkage arms are configured to move along with the driven body to drive the terminal fitting mechanism by at least one of the plurality of linkage arms to correspondingly adjust a size of the terminal channel.

8. The terminal crimping machine according to claim 7, wherein the terminal fitting mechanism comprises a first sliding block and a second sliding block, the first sliding block is configured to slide relative to the machine body, the terminal channel is disposed between the first sliding block and the second sliding block, the plurality of linkage arms are arranged corresponding to the first sliding block, at least one of the plurality of linkage arms drives the first sliding block to slide to adjust the size of the terminal channel.

9. The terminal crimping machine according to claim 8, wherein the second sliding block is configured to slide relative to the machine body, the plurality of linkage arms are arranged corresponding to the first sliding block and the second sliding block respectively, at least one of the plurality of linkage arms drives the first sliding block to slide and at least another one of the plurality of linkage arms drives the second sliding block to slide to jointly adjust the size of the terminal channel.

10. The terminal crimping machine according to claim 9, wherein the terminal fitting mechanism further comprises a fixation base fixed on the machine body, the fixation base comprises a side surface, the first sliding block and the second sliding block are slidably attached to the fixation base and arranged on the side surface, the first sliding block and the second sliding block slide along the side surface.

11. The terminal crimping machine according to claim 10, wherein the first sliding block is connected with a first linkage portion, the second sliding block is connected with a second linkage portion, the first linkage portion and the second linkage portion are arranged parallel to each other on a top surface of the fixation base and are slidably attached to the fixation base.

12. The terminal crimping machine according to claim 11, wherein the second sliding block is connected with an extension portion, a straddling portion is connected between the extension portion and the second linkage portion, the extension portion is located on a bottom surface of the fixation base.

13. The terminal crimping machine according to claim 10, wherein the fixation base comprises a plurality of insertion holes, the first linkage portion and the second linkage portion are jointly connected with a plurality of insertion rods, each one of the insertion rods is slidably inserted in each one of the insertion holes correspondingly.

14. The terminal crimping machine according to claim 7, wherein the adjustment member is connected with a driving portion, the driven member comprises a first driven member, the driven body is connected with a second driven member, the driving portion is configured to drive the first driven member and the second driven member simultaneously, and the driven body is configured to move along with the second driven member.

15. The terminal crimping machine according to claim 7, further comprising a terminal automatic feeding device configured to feed the terminal automatically, and the terminal automatic feeding device comprising a feed opening, wherein the feed opening communicates with the terminal channel correspondingly.

* * * * *